United States Patent [19]

Crislip et al.

[11] 4,444,383

[45] Apr. 24, 1984

[54] ROTARY SLOTTER SHEET FEEDER

[75] Inventors: Paul F. Crislip, Plainwell; Frederick W. Harrison, Richland, both of Mich.

[73] Assignee: Hycorr Machine Corporation, Kalamazoo, Mich.

[21] Appl. No.: 304,530

[22] Filed: Sep. 22, 1981

[51] Int. Cl.[3] ..... B65H 5/08

[52] U.S. Cl. ..... 271/14; 271/102; 271/106; 271/108; 271/30 R; 271/157

[58] Field of Search ..... 271/14, 90, 91, 106, 271/108, 30 R, 157, 102

[56] References Cited

U.S. PATENT DOCUMENTS

| | | | |
|---|---|---|---|
| 1,898,535 | 2/1933 | Haupt | 271/14 UX |
| 2,654,603 | 10/1953 | Williams | 271/159 |
| 3,034,783 | 5/1962 | Christa | 271/14 |
| 3,193,282 | 7/1965 | Stewart | 271/12 |
| 3,599,967 | 8/1971 | Rapparlie | 271/12 |
| 3,737,034 | 6/1973 | Icard | 209/84 |
| 3,830,489 | 8/1974 | Adams | 271/9 |
| 4,002,332 | 1/1977 | Hoenigmann | 271/11 |
| 4,003,567 | 1/1977 | Berger, Jr. et al. | 271/12 |
| 4,327,906 | 5/1982 | Frohlich | 271/108 X |

*Primary Examiner*—Richard A. Schacher

*Attorney, Agent, or Firm*—Flynn, Thiel, Boutell & Tanis

[57] ABSTRACT

An apparatus is provided to pick up single sheets of semi rigid material from a stack and convey them to a further location. The pick up mechanism employs a primary carriage assembly supported for horizontal linear movement. A row of vertically movable suction devices mounted on the carriage lift the sheet adjacent a trailing edge. A secondary carriage including finger elements engages the raised sheet to push it across the stack into nip rollers.

13 Claims, 9 Drawing Figures

ROTARY SLOTTER SHEET FEEDER

FIELD OF THE INVENTION

This invention relates to an improved sheet handling apparatus, and more particularly, to an apparatus for successively picking up single sheets of semi-rigid material, such as corrugated or fiber paperboard, from the top of a stack of such sheets and conveying them away from the stack to a suitable use location, and in particular to a rotary slotter.

BACKGROUND OF THE INVENTION

The feeding of single large sheets of corrugated paperboard to rotary slotters is conventionally accomplished utilizing substantial manual manipulations in order to control and regulate the supply of the sheets, and the position of same, on the feed chain which supplies the individual sheets to the rollers. This manual operation has generally been utilized in view of the difficulty in removing single sheets of semi-rigid corrugated paperboard from the stack, and then successfully handling and transferring same to the slotter. However, these manual manipulations are obviously time and labor consuming, so that the overall operation is hence extremely inefficient and expensive. Thus, the cutting, slitting or printing of sheets using this technique has long been recognized as inefficient and expensive, but nevertheless has been utilized in many instances in view of the unavailability of relatively inexpensive and efficient equipment capable of performing these steps automatically.

While some rotary slotters, particularly printertype slotters, have utilized high speed automatic reciprocating-type feed mechanisms for supplying individual sheets from a stack to the slotter, nevertheless these known devices are of extreme mechanical complexity so as to make their maintenance and repair extremely difficult, and these devices are also initially of great expense. For this reason, these devices have been considered wholly unsuitable by many operators of rotary slotters, and particularly those operators who utilize their equipment on a much smaller scale.

In an attempt to provide such an automatic sheet feeding device for a rotary slotter, and specifically a device of lesser cost and complexity so as to be suitable for operations of smaller scale, there has been developed the sheet pick-up and feeder device illustrated by U.S. Pat. No. 4,003,567. With this device, however, the pick-up and transfer of the individual sheets requires the use of a reciprocating suction mechanism which is mounted on and controlled by a linkage which interconnects same to an endless chain so that the overall mechanism including the suction members hence undergoes a rather complex cycle movement, whereby the resulting mechanism is both complex and the rate of feeding sheets is slower than desired, and is restricted with respect to the capability of being adjusted so as to handle sheets having a substantial range of widths. Also, this apparatus is driven from the slotter and hence requires complex drive trains.

Accordingly, the present invention relates to an improved apparatus for handling stacks of sheets, particularly sheets of semi-rigid material such as corrugated paperboard, and for permitting a single sheet to be picked up and movably advanced for supply to a further processing apparatus, specifically a rotary slotter.

In the improved apparatus, there is provided an elevator for receiving thereon a stack of sheets. The elevator is of an open framework so that a plurality of belt conveyors are positioned within the open framework of the elevator, which belt conveyors are aligned with additional conveyors positioned adjacent but spaced sidewardly of the elevator. A stack of sheets can be automatically conveyed from these side conveyors onto the belt conveyors, when the elevator is in its lowered position, whereby the belt conveyors move the stack into position against a support plate. The elevator is raised to lift the stack away from the belt conveyors, which lifting is controlled by a sensor, such as a photocell, which maintains the top of the stack within a selected vertical range so that a small number of individual sheets can be removed, following which the elevator will be automatically lifted so that the top of the stack is always maintained within a selected range of positions. A pick-up and advancing mechanism is disposed above the elevator for lifting the rear edge of the top sheet and then slidably advancing the sheet forwardly between pairs of nip rollers, the lowermost nip rollers being associated with a set of downwardly inclined conveyor belts which then feed the separated sheet onto the chain conveyor associated with the rotary slotter.

In this apparatus, the pick-up and advancing mechanism employs a primary carriage assembly which is supported for horizontal linear movement in the widthwise direction of the stacked sheets, which main carriage is activated when the stack is positioned on the elevator so that appropriate positioning elements are disposed directly adjacent one side edge of the stack, thereby permitting adjustment for sheets of different size. This main carriage also mounts thereon a row of vertically movable suction devices which engage the top sheet adjacent the trailing edge thereof for permitting this trailing edge to be lifted upwardly a selected extent. A secondary carriage is supported on the primary carriage for linear reciprocating movement in the same direction, which secondary carriage mounts thereon a row of pushing elements which include fingers which are adapted to move into position below the raised rear edge of the sheet for supporting the rear edge in a raised position when the suction members release the sheet. This secondary carriage and the pushing elements thereon are advanced widthwise across the stack so as to push the leading edge of the top sheet into the nip rollers. When the secondary carriage reaches its forward stroke position, an appropriate control reverses the secondary carriage and causes it to automatically return to its initial retracted position, and simultaneously therewith the suction devices are again energized to create a suction therein and are moved downwardly to both engage the next top sheet and are then moved upwardly to raise the rear edge of this next top sheet so that same is in a raised position simultaneous with the return of the secondary carriage to its retracted position, whereby the apparatus is in position to initiate a further cycle. Each cycle of the pick-up and advancing mechanism is initiated by a limit switch associated with the drive chain of the rotary slotter, which sensor initiates a new cycle whenever the previously-removed sheet reaches a preselected position on the chain feeder of the slotter.

It is an object of the improved apparatus, as described above, to permit single sheets to be rapidly and efficiently removed from a stack and fed to the chain feeder of a rotary slotter, with the feeding of the single sheet from the stack to the rotary slotter being controlled by and synchronized with the feed chain of the slotter to permit the overall operation to be carried out at a rapid rate and in a substantially wholly automated manner so as to provide optimum efficiency while requiring minimum manual supervision and control.

A further object of the invention is to provide an improved apparatus, as aforesaid, which is of minimal mechanical complexity so as to provide optimum reliability and efficiency, and at the same time enable the apparatus to be manufactured and operated with minimal expense.

A still further object is to provide an improved apparatus, as aforesaid, which is provided with its own motors and drive mechanisms so as to minimize or eliminate driving connections from the rotary slotter, with the drives and cyclic actuation of the apparatus being controlled by a signal received from the rotary slotter in dependence on the positioning of a sheet thereon, whereby the apparatus can be utilized in association with conventional rotary slotters without having to substantially modify or rebuild the drive train thereof.

Another object is to provide an improved apparatus, as aforesaid, which utilizes a pneumatic system for controlling many of the essential mechanisms and devices, such as the suction elements and the movement of the secondary carriage, so as to simplify the overall mechanical complexity of the apparatus. This improved apparatus also facilitates the supplying of stacks of sheets thereto so as to simplify this operation and permit it to be accomplished more automatically, and at the same time this apparatus utilizes an improved elevator mechanism combined with a supply conveyor so as to facilitate the overall transfer and handling of stacks of sheets.

Other objects and purposes of the invention will be apparent to persons familiar with systems of this general type upon reading the following specification and inspecting the accompanying drawings.

Figures 1A, 8:
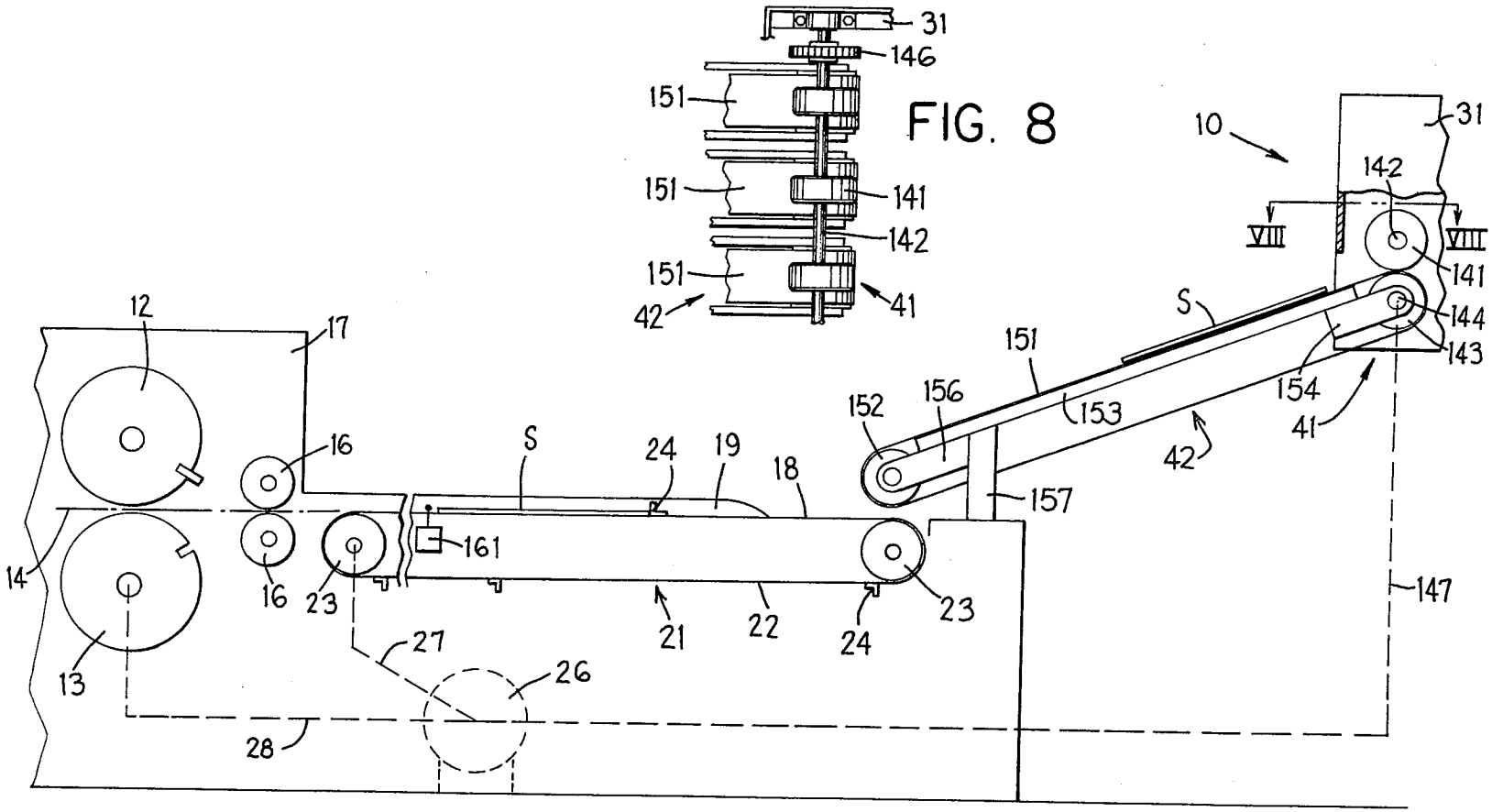
FIG. 8 is a fragmentary top view taken substantially along line VIII—VIII in FIG. 1A.

Certain terminology will be used in the following description for convenience in reference only and will not be limiting. For example, the words "upwardly," "downwardly," "leftwardly" and "rightwardly" will refer to directions in the drawings to which reference is made. The words "inwardly" and "outwardly" will refer to directions toward and away from, respectively, the geometric center of the apparatus and designated parts thereof. The word "forwardly" will refer to the normal direction of movement of sheets through the apparatus, which direction is generally leftwardly in FIGS. 1–3. Said terminology will include the words specifically mentioned, derivatives thereof, and words of similar import.

DETAILED DESCRIPTION

Figure 1B:
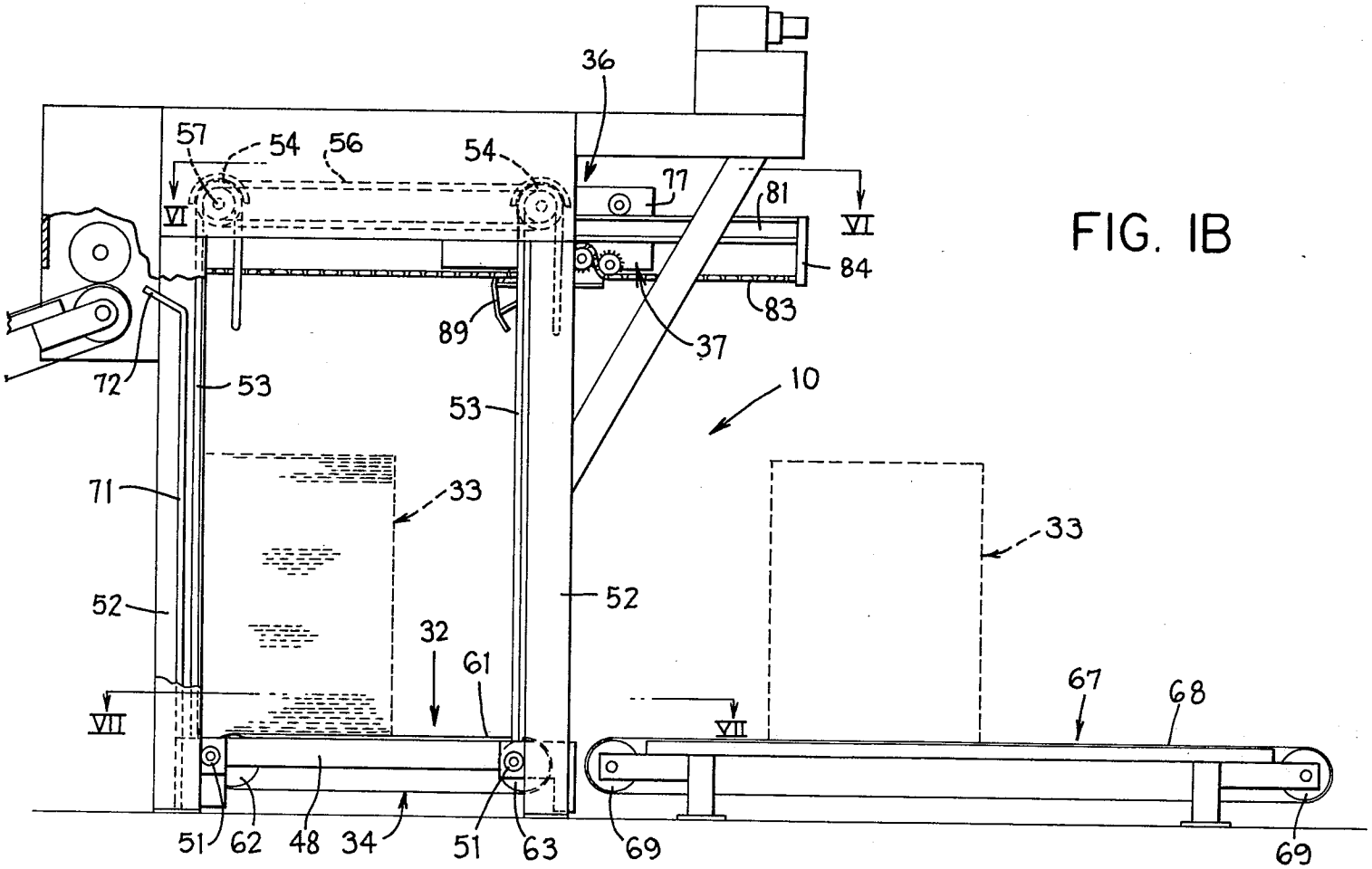
FIG. 1 is a side elevational view which diagrammatically illustrates the apparatus of this invention in combination with a conventional rotary slotter, and is specifically divided into two portions, with FIG. 1A illustrating a conventional rotary slotter and its association with the discharge end of the improved sheet handling apparatus, with FIG. 1B showing the remainder of the sheet handling apparatus and specifically the input end thereof and the pick-up and advancing mechanism.

Referring to FIGS. 1A and 1B, there is illustrated a sheet handling apparatus 10 according to the present invention, which apparatus is designed particularly for use with a rotary slotter 11.

As illustrated by FIG. 1A, the rotary slotter 11 is of substantially conventional construction in that it includes a pair of opposed counter-rotating rolls 12 and 13 which define a nip therebetween for permitting passage of planar sheets substantially along the horizontal plane 14. These rolls 12–13, as is conventional, are provided with appropriate cutting or slitting tools. A further pair of nip rolls 16 are normally provided directly adjacent the inlet side of the rolls 12–13 for assisting in guiding the sheet. The housing 17 of the slotter defines thereon an upwardly facing planar support surface 18, along one side of which there is provided a guide member 19, for slidably moving a sheet toward the nip rolls 16. An endless chain drive device 21 is provided for feeding the sheet. This chain drive device 21 includes a pair of sidewardly spaced endless chains 22 which are supported on and extend between appropriate sprockets 23, which sprockets adjacent one end of the slotter are joined together by a common shaft and are appropriately driven, such as by a suitable drive train (as indicated by the dotted line 27) from the drive motor 26. The sidewardly spaced chains 22 are joined together by a plurality of L-shaped drive lugs 24 which are at suitably spaced intervals so that the lug engages the rear edge of the sheet S as supported on the support surface 18 so as to push same into the nip between the rollers 16. The same motor 26 also normally drives the rollers 12–13 by means of a suitable drive train (as indicated by the dotted line 28). The drive of the rollers 12–13 and the chain drive device 21 are appropriately synchronized.

The structure and operation of the slotter 11 is conventional and well known to those familiar with such devices, so that further description of same is believed unnecessary.

Figure 2:
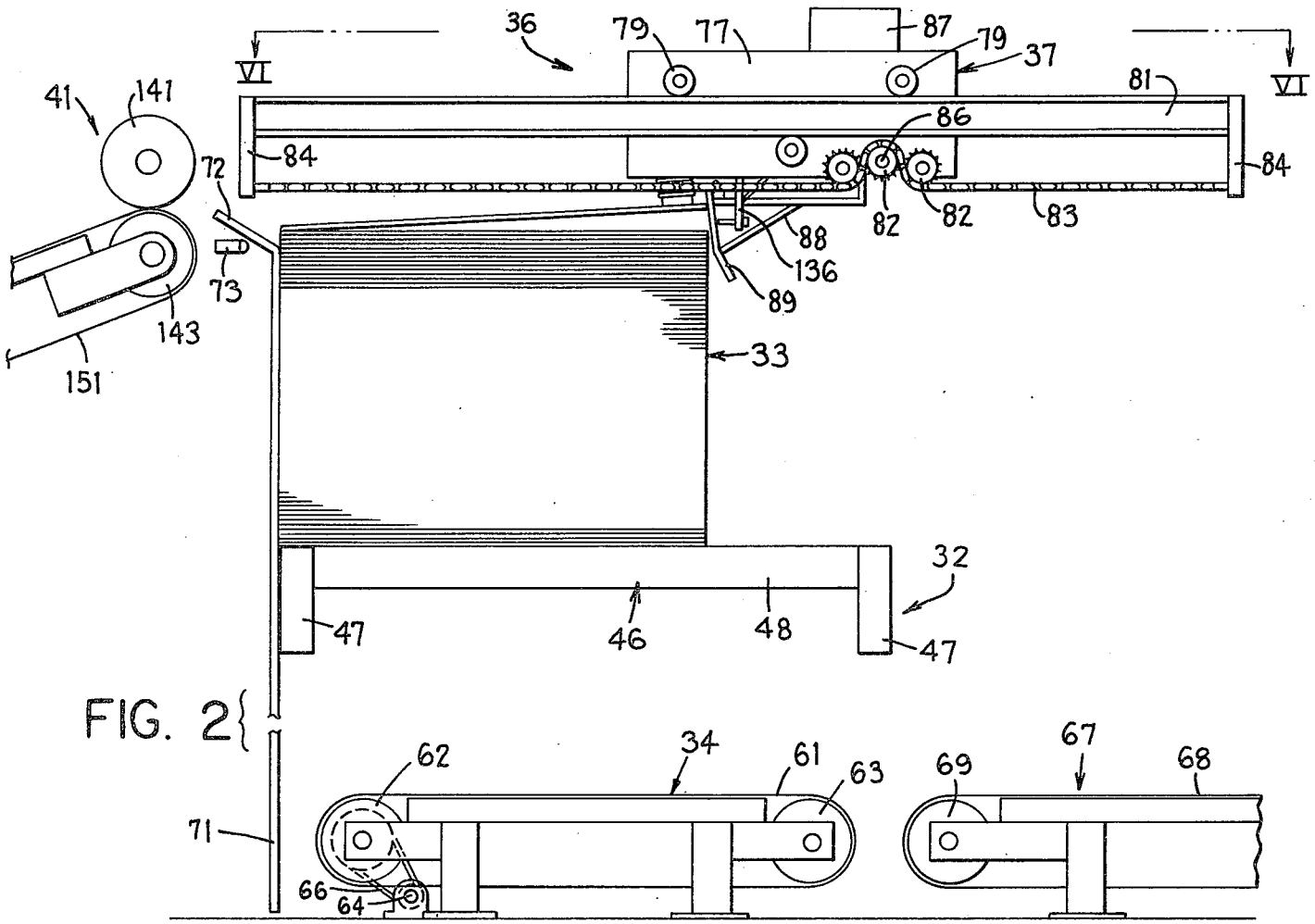
FIG. 2 is a fragmentary, enlarged, side elevational view similar to FIG. 1B but illustrating the sheet pick-up and advancing mechanism in greater detail.
Figure 3:
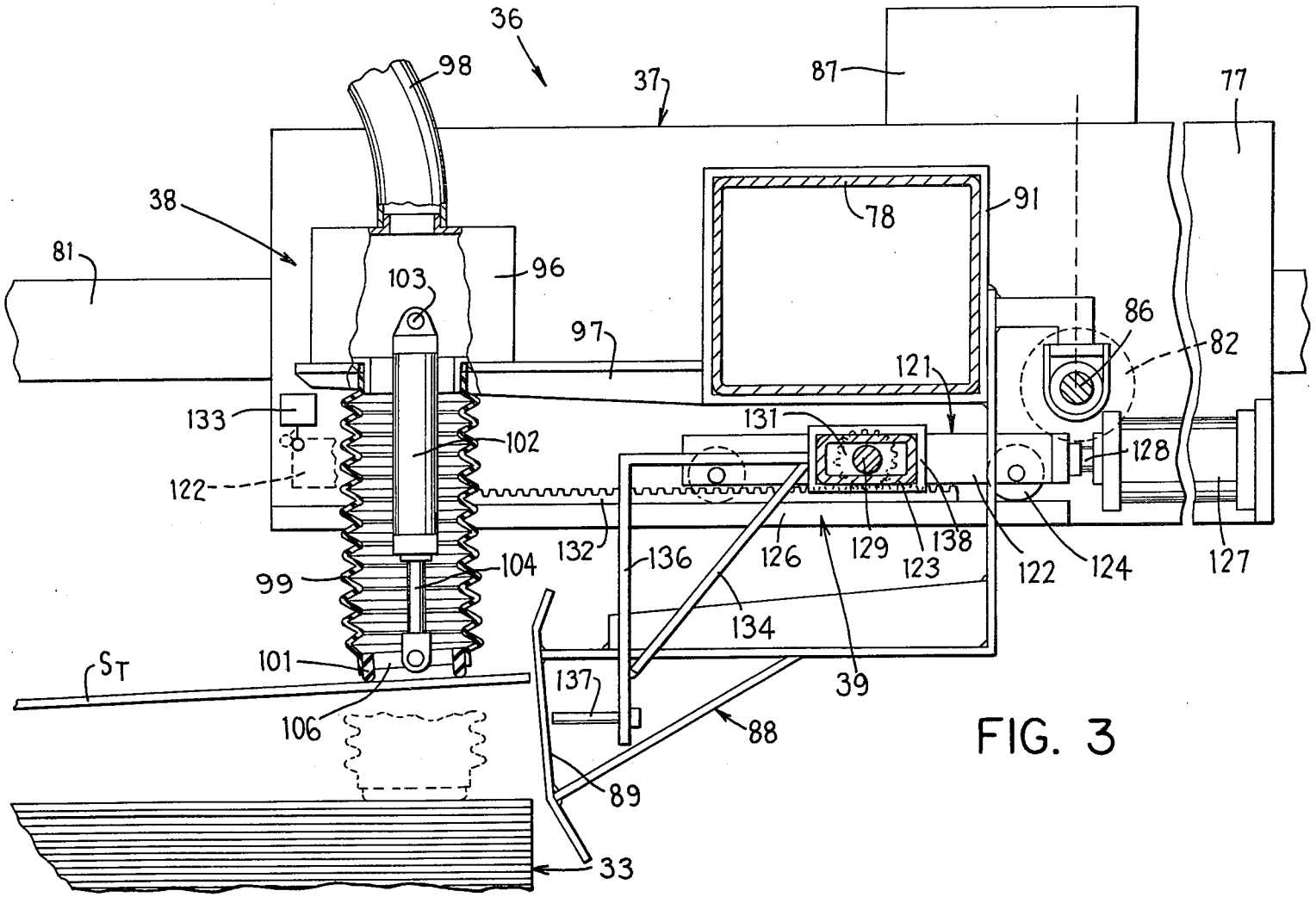
FIG. 3 is an enlarged, fragmentary, sectional elevational view illustrating portions of the sheet pick-up and advancing mechanism.

Considering now the sheet handling apparatus 10, and referring specifically to FIGS. 1B, 2 and 3, same includes a frame or housing 31 which sets on a suitable support surface such as a floor. The frame has an appropriate elevator means 32 thereon for supporting and lifting a stack 33 of thin semi-rigid sheets S, such as corrugated paperboard sheets, which sheets normally are of large size with respect to their horizontal width and length dimensions. The elevator means 32 has an appropriate conveyor means 34 associated therewith for properly moving the stack 33 into position. A sheet pick-up and advancing mechanism 36 is supported on the frame 31 above the elevator means. This mechanism 36 includes a main carriage means 37 which is horizontally linearly movable in the widthwise direction of the sheets, and this carriage means 37 supports thereon a suction-type pick-up device 38 for engaging and lifting the rearward edge of the topmost sheet $S_t$. The main carriage 37 also movably supports thereon a sheet advancing mechanism 39 which movably advances the top sheet $S_t$ forwardly into engagement with a pinch roller device 41, the latter then driving the sheet forwardly onto a conveyor means 42, which in turn moves the sheet onto the slotter support surface 18 so as to be in position for engagement with the drive lug 24.

Considering first the elevator means 32, same includes a substantially horizontal platform 46 which is of an open framework construction. This platform 46 includes parallel end rails 47 rigidly joined together by transversely extending, parallel side rails 48, thereby defining a substantially rectangular ring-like structure. A plurality of intermediate cross rails 49, at substantially uniform intervals, extend transversely between the end rails 47 in parallel relationship to the side rails 48. This arrangement results in the platform 46 having a plurality of sidewardly displaced rectangular openings of rather large size extending vertically therethrough, which openings accommodate therein a plurality of individual conveyor units which make up the conveyor means 34, as described hereinafter.

The elevator platform 46 is raised and lowered by a drive mechanism which includes a plurality of elongated chains 53, the lower end of one of the chains 53 being secured adjacent each corner of the platform 46, with the upper portion of each chain being confined in driving engagement with a suitable sprocket 54 as rotatably supported on the upper portion of the frame. A pair of such sprockets are disposed on each side of the frame over each side edge of the elevator, which sprockets are suitably joined for synchronous rotation by an appropriate endless chain 56. Two of the aligned sprockets 54 are suitably nonrotatably connected by a shaft 57, which shaft in turn is suitably interconnected to a conventional reversible drive motor as mounted on the frame for controlling the raising and lowering of the elevator platform 46. Appropriate guide rollers 51 are mounted on the four corners of the platform 46, which rollers are suitably rollingly confined and guided by pairs of parallel uprights 52 which are disposed adjacent the side edges of the platform, which uprights 52 define a part of the overall frame 31.

Figure 7:
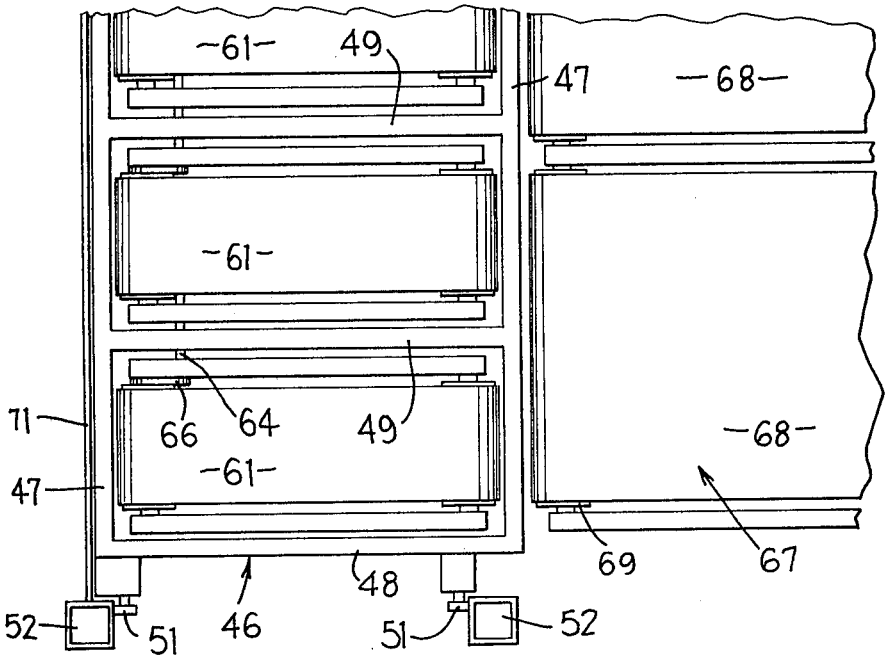
FIG. 7 is a fragmentary top view taken substantially along line VII—VII in FIG. 1B.

The conveyor means 34, which interfits within the rectangular openings formed in the platform 46 when the latter is in its lowermost position (as shown by FIGS. 1B and 7) includes a plurality of endless conveyor belts 61 disposed in sidewardly positioned relationship across the width of the apparatus. Each conveyor belt 61 is supported on appropriate end rollers 62 and 63 so that the upper reach of belt 61 moves forwardly (from right to left in FIGS. 1B and 7). Also, the upper reach of the belts 61 are disposed at an elevation which is slightly above the upper surface of the elevator platform 46 when the latter is in its lowermost position as illustrated by FIG. 1B. These conveyor belts 61 are synchronously driven from a drive shaft 64 which extends horizontally across the apparatus closely adjacent the floor, which shaft 64 is drivingly connected to the individual end rollers 62 by suitable drive mechanisms, such as an appropriate chain mechanism 66. This shaft 64 is in turn suitably driven by a conventional drive motor (not shown) which is positioned adjacent and suitably drivingly connected to one of the projecting ends of said shaft 64. This drive motor for shaft 64 can be suitably energized by the operator whenever a stack of sheets 33 is to be moved into position over the elevator platform 46.

To facilitate the movement of a stack of sheets 33 onto the conveyor belts 61, there is also preferably provided a feed conveyor system 67. This latter system 67 is designed to permit one or more stacks of sheets to be supported thereon. The system 67 includes a plurality of endless belts 68 suitably supported on end rollers 69, which rollers at one end are suitably joined by a through shaft which is connected to and rotatably driven by a suitable drive motor (not shown), whereupon this drive motor can be actuated by an operator so as to move the belts 68 and thus advance the stacks thereon when desired. The frontmost end roller 69 is positioned closely adjacent but slightly spaced from the rear roller 63 by a sufficient distance to enable the rear end rail 47 of platform 46 to be positioned therebetween when the platform is in its lowered position. However, the adjacent ends of these conveyor belts 61 and 67 are positioned as close together as possible, and the upper reaches of these belts 61 and 67 are also substantially horizontally coplanar, so as to permit the stack of sheets to be automatically transferred from the moving conveyor belts 67 onto the moving conveyor belts 61 and then moved forwardly (leftwardly) therealong until the front edge of the stack 33 is positioned substantially in abutting engagement with the vertical guide means 71.

This guide means 71 comprises, in the illustrated embodiment, a vertically extending plate which projects upwardly through a substantial extent directly adjacent the front end rail 47 of the elevator platform 46. This vertical plate 71 defines the frontmost position for the stack of sheets 33, and slidably guides the front edge of the stack as the elevator platform 46 is moved upwardly. This vertical guide plate 71 has, at its upper edge, a guide flange 72 which projects forwardly (that is, away from the stack of sheets) in a direction toward the pinch roller device 41. This guide flange 72 is sloped upwardly at a relatively small angle (such as in the neighborhood of 30°) as it projects forwardly so that the free edge of this flange 72 is hence able to direct the leading edge of a sheet into the nip of the pinch roller device 41.

To regulate and maintain the elevation of the sheet stack 33, there is provided a sensor 73, specifically a conventional photocell. This sensor 73 is disposed substantially at the elevation of the upper edge of the vertical portion of the guide plate 71, which guide plate can be suitably slotted or recessed so that the beam from the photocell 73 can pass therethrough and thereby sense the presence of the top of the sheet stack 33. This photocell has a range of sensitivity so as to cover an elevation equivalent to the thickness of several sheets, such that so long as the sensor indicates the presence of one or more sheets within this range, the elevator remains stationary. However, when the sensor 73 no longer senses the presence of any sheet, then the drive motor for the elevator is energized and the elevator moves slowly upwardly through a preselected distance, following which the elevator is automatically stopped and held in this raised position. The sensor 73 is positioned so as to permit several individual sheets, such as about three or four sheets, to be removed prior to each increment of movement of the elevator.

The sheet pick-up and advancing mechanism 36 will now be considered, particularly with reference to FIGS. 2 and 3. This mechanism 36 is designed for initially engaging and lifting the rearward edge portion of the topmost sheet $S_t$ through a selected distance, following which the sheet is then slidably moved forwardly so that the leading edge of the top sheet $S_t$ is cammed upwardly by the flange 72 and moved into engagement with the pinch roll device 41, whereupon the latter drives the sheet forwardly so that the mechanism 36 can move rearwardly to permit initiation of a new cycle.

As previously noted, this mechanism 36 includes a main carriage 37 movably supported on the frame 31. This main carriage 37 is of a substantially H-shaped configuration when viewed from above, and includes a pair of side trolleys 77 which are sidewardly spaced apart and rigidly joined together by an elongate intermediate element 78 which is of substantially tubular cross section. This element 78 thus extends transversely across the width of the apparatus. The pair of trolleys are provided with appropriate rollers 79 for rollingly supporting the trolleys, and hence the main carriage 37 on a pair of parallel, horizontally elongated rails 81 which are part of the machine frame and extend substantially in the sheet-transfer direction. These rails 81, as illustrated by FIG. 2, are positioned upwardly a substantial distance above the elevator platform.

To effect back-and-forth movement of the carriage 37 along the rails 81, the pair of trolleys 77 are each provided with a set of three sprockets 82 disposed in engagement with an elongated chain 83, the opposite ends of which are fixedly anchored to end plates 84 as associated with the respective rail 81. The centermost sprockets on the two trolleys 77 are nonrotatably interconnected by a shaft 86 so as to synchronize the movement of the two trolleys.

In addition, an appropriate drive device 87, such as a motor and appropriate gear mechanism or suitable drive train, is supported on the elongate tube 78 and is drivingly interconnected to the shaft 86 for drivingly rotating the center sprockets. In this manner, when this reversible drive device 87 is energized, the driven sprockets 82 react against the chain 83 so as to effect linear displacement of the main carriage 37 in the selected direction along the rails 81. The drive device 87 preferably has a suitable brake device, such as a conventional pneumatic-actuated brake, associated therewith for stationarily holding the carriage 37 in a desired position.

The main carriage 37 has a plurality of positioning members 88 mounted thereon at spaced intervals along the elongate tube 78. Each of these positioning elements 88, as illustrated by FIG. 3, includes a vertically elongated guide plate 89 which is disposed adjacent the upper rear edge of the stack 33 and projects upwardly therefrom for suitably guiding the rear edge of the uppermost sheet $S_t$ as it is being raised. This positioning element 88 also functions for defining the proper position for the main carriage 37 in correspondence with the width of sheets being handled. The positioning member 88 is disposed substantially below and projects forwardly of the elongate tube 78 and is suitably secured to a substantially rectangular support tube 91 which surrounds and is slidably supported on the tube 78. Several such positioning elements 88 are supported on and suspended downwardly from the tube 78 at spaced intervals therealong.

Figure 4:
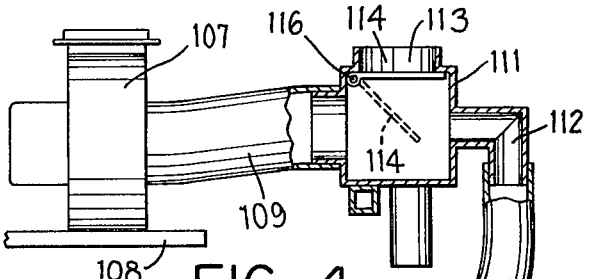
FIG. 4 is an enlarged, fragmentary elevational view, partially in cross section, illustrating the suction system.
Figure 5:
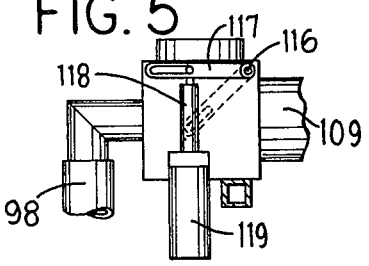
FIG. 5 is a fragmentary elevational view illustrating the rear side of the suction box shown in FIG. 4.

Considering now the suction pick-up device 38, and referring specifically to FIGS. 3–5, there are a plurality of such devices 38 positioned within a row which extends in the widthwise direction of the machine, with such devices being spaced apart at substantially uniform intervals for permitting the top sheet $S_t$, adjacent its rear edge, to be engaged at several points therealong for purposes of lifting.

This pick-up device 38, as shown by FIG. 3, has a suction box 96 which is stationarily mounted on a bracket 97, the latter being secured to and projecting outwardly from the elongate tube 78. The lower end of a suction hose or conduit 98 is connected to the suction box 96 for communication with the interior thereof, which box 96 also is connected to the upper end of an elongate and extendible tubular bellows 99. This bellows 99 projects downwardly and, at its lower free end, is provided with an annular seal ring 101 which is of an elastomeric material and is adapted to be moved into contact with the top sheet $S_t$. This bellows 99 and the seal ring 101 hence effectively function as a suction member for engagement with and lifting of the sheet $S_t$.

The extension and contraction of bellows 99 is controlled by a fluid pressure cylinder 102, specifically a double-acting pneumatic cylinder, the housing of which is supported by a hinge pin 103 so as to enable the cylinder and hence the bellows to angularly deflect in the widthwise direction of the sheet to compensate for the angular deflection of the sheet during lifting. The cylinder 102 has its piston rod 104 projecting downwardly therefrom, which rod at its free end is hingedly connected to a spider or rib 106 which is fixed to and extends across the seal ring 101.

As illustrated by FIG. 4, a centrifugal type blower 107 is mounted on a portion 108 of the frame, and the inlet of this blower has a suction intake conduit 109 connected thereto, which conduit has a suitable flapper-type valve device associated therewith. This latter valve device includes a control box 111 which is connected to the conduit 109 at one side thereof, and is provided with an elbow 112 at the other side thereof, the latter being connected to the upper end of the suction hose 98. This control box 111, which is also supported on a portion of the frame, has an upwardly directed opening 113 for providing communication between the interior of control box 111 and the surrounding atmosphere. A valve plate 114 is positioned within the control box 111 for controlling opening and closing of this atmosphere-communicating opening 113. Valve plate 114 is secured to a shaft 116 which is swingably supported on the control box 111 and projects outwardly thereof, and an elongate lever 117 is secured to a projecting end of shaft 116. Lever 117 is in turn connected to the free end of a piston rod 118 which is associated with a fluid pressure cylinder 119, the latter preferably being a double-acting pneumatic cylinder. Actuation of the cylinder 119 hence moves the valve 114 between the closed position as illustrated by solid lines in FIGS. 4–5, which position results in creation of a suction within hose 98, and the open position indicated by dotted lines in FIGS. 4–5 whereby control box 111 communicates through opening 113 with the atmosphere so as to effectively disrupt or eliminate the suction within the hose 98.

While only one pick-up device 38 is illustrated in the drawings, it will be appreciated that a plurality of blowers 107 are mounted on the frame across the width thereof, and a corresponding plurality of control boxes 111 are also provided, although normally each control box 111 can connect to at least two suction hoses so as to control the suction within two adjacent bellows 99.

Figure 6:
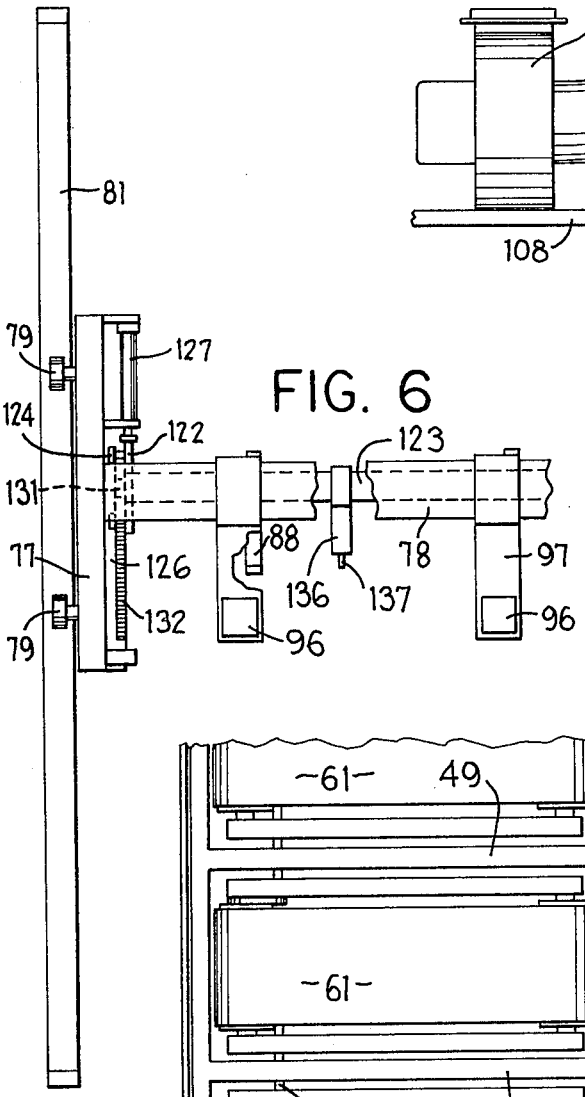
FIG. 6 is a fragmentary top view showing a portion of the pick-up and advancing mechanism, as taken substantially along line VI—VI in FIGS. 1B and 2.

Considering now the sheet advancing mechanism 39, and referring specifically to FIGS. 3 and 6, same includes a secondary carriage means 121 which is supported on the main carriage 37 for linear reciprocating movement therealong in a horizontal direction which extends in the widthwise direction of the top sheet $S_t$, which movement is hence parallel with the movement direction of the main carriage.

This secondary carriage 121 is also of a substantially H-shaped configuration when viewed from the top, and includes a pair of trolleys 122 which are rigidly joined together by an intermediate horizontally elongate element or tube 123 which extends transversely of the machine. Each trolley 122 has rollers 124 thereon which are rollingly supported on a horizontally elongated rail 126 which is fixed to a respective one of the trolleys 77, which rail projects horizontally in the widthwise direction of the sheet stack. Each trolley 77 also mounts thereon the housing of a fluid pressure cylinder 127, specifically a double-acting pneumatic cylinder, the piston rod 128 of which is connected to the rearward end of the respective trolley 122 for controlling the back-and-forth movement thereof along the rail 126. This trolley 122, as illustrated in FIG. 3, is in its rearwardmost or retracted position, which position is limited by an appropriate stop (not shown) or by the internal stop which limits the compression of the cylinder 127.

To synchronize the movement of the two trolleys 122, they are joined together and rotatably support the opposite ends of an elongate shaft 129 which extends through the elongate tube 123 and has appropriate gears 131 fixed on opposite ends thereof, which gears are maintained in meshing engagement with an elongated gear rack 132 which is fixedly associated with each trolley 77 and extends along a respective rail 126.

The forwardmost position of the secondary carriage 121, and hence the forwardmost position of the advancing mechanism, is determined by the engagement of the leading edge of one of the trolleys 122 with an appropriate reversing control, specifically a limit switch 133 as illustrated in FIG. 3.

This secondary carriage 121 mounts thereon a plurality of sheet engaging elements 134, which elements 134 are at spaced intervals in the widthwise direction of the machine and are positioned intermediate the positioning elements 88 so as to not interfere therewith. Each of these sheet engaging elements 134 has a substantially tubular mounting portion 138 which surrounds the elongate tube 123 and is also provided with a substantially vertical pusher plate 136 which projects downwardly through a sufficient extent so as to enable this pusher plate to abuttingly engage the rear edge of the top sheet $S_t$ when the latter is in a lifted or raised position. Each pusher plate 36, adjacent the lower end thereof, has an appropriate support pin 137 projecting horizontally forwardly thereof, which pin is disposed at an elevation above the normal top of the sheet stack 33 but below the raised rear edge of the top sheet $S_t$.

The above-described sheet advancing mechanism 39 causes the leading or front edge of the top sheet $S_t$ to be moved into gripping engagement with the nip of the pinch roller device 41. This latter device, as illustrated by FIGS. 1A and 8, includes a plurality of coaxially aligned upper rollers 141 nonrotatably secured to a shaft 142 which extends horizontally in the width-wise direction of the apparatus and is appropriately rotatably supported on the frame 31. These upper rollers are pneumatically inflated rollers similar to rubber tires. A further plurality of lower rollers 143 are coaxially aligned and nonrotatably secured to a further shaft 144, with these rollers 143 being disposed directly below respective ones of the upper rollers 141 so as to create a narrow nip or gap therebetween suitable for acommodating but permitting driving engagement with the sheet S. The shafts 142 and 144 are appropriately drivingly connected together for counter-rotation by means of a suitable gear mechanism, as diagrammatically indicated by the upper gear 146 in FIG. 8. One of these shafts 142 and 144 is also drivingly connected to the motor 26 of the slotter by means of an appropriate drive train, as diagrammatically indicated by the dotted line 147 in FIG. 1A. The rollers of the pinch device are hence rotated continuously and in synchronization with the rotational movement of the slotter whenever the latter is activated.

The pinch roller device is also integrated with the discharge conveyor means 42 and, as illustrated by FIGS. 1A and 8, this latter conveyor means includes a plurality of endless belts 151 which have the upper ends thereof supported on and drivingly engaged with the rolls 143, with the lower ends of these belts being supported on appropriate end rollers 152. One such belt 151 is associated with each lower nip roller 143 so that the conveyor 42 is thus defined by a plurality of narrow belts 151 disposed in adjacent side-by-side relationship. Each belt 151 is supported by an appropriate frame structure which includes a substantially flat plate 153 which extends under and effectively supports the upper reach of the belt 151 so that the latter projects forwardly and downwardly at a suitable angle for depositing the sheet S onto the upper support surface on the slotter. This support plate 153 has its upper end attached to an end plate 154 which is suitably rotatably supported on the shaft 144, and a further end plate 156 is attached to the other end for supporting the shaft of the lower end roller 152. A support leg 157 is also attached to the conveyor frame for supporting the lower discharge end of the conveyor 42 on the slotter in close proximity to the upper upstream and of the endless drive chain 21.

OPERATION

The overall operation of the sheet handling apparatus 10, and its association with the rotary slotter 11, will now be briefly described.

Assuming the apparatus 10 and slotter 11 to be in continuous operation and the apparatus 10 to have a sheet stack 33 thereon substantially as illustrated in FIGS. 2 and 3, then the motor 26 of the slotter will cause continuous rotation of the rolls 12-13, the chain 21, the nip rollers 141 and 143 and the conveyor belts 151. Further, the normal "park" position of the apparatus 10, specifically the sheet pick-up and advancing mechanism 36, corresponds substantially to that illustrated by FIGS. 2 and 3. In this "park" or initial position, the main carriage 37 is maintained stationary during successive sheet-advancing cycles with the positioning elements 88 being disposed directly adjacent the rear upper edge of the sheet stack 33, so that the bellows elements 99 are disposed adjacent the rear edge of the top sheet. Further, the valve plates 114 are maintained in the closed position indicated in FIGS. 4–5, and hence a suction is thus created within the bellows 99 so that the latter maintain the rear edge portion of the top sheet $S_t$ deflected upwardly into a raised position. The secondary carriage 121 is maintained in its retracted position so that the sheet engaging elements 134 are positioned adjacent but spaced rearwardly from the rear edge of the raised top sheet $S_t$.

With the apparatus 10 in this park or initial position as described above, the next sheet-advancing cycle is not initiated until a previously fed sheet is already positioned on and is being advanced forwardly by the chain conveyor 21 of the slotter, such that when the leading edge of this sheet S illustrated in FIG. 1A contacts an appropriate sensor, specifically a limit switch 161 as associated with the slotter drive chain 21. This limit switch 161 thus energizes appropriate control circuitry for the apparatus 10 so that the next advancing cycle is initiated. Specifically, when limit switch 161 is activated by the leading edge of the sheet S supported on the feed table of the slotter, this causes the cylinders 127 to be activated so as to forwardly advance the secondary carriage 121 so that pusher plates 136 move toward and abuttingly engage the rear edge of the top sheet $S_t$, and simultaneously the projecting pins 137 move under the rear edge of the top sheet to support same in a raised position. Simultaneous with this forward advance of the secondary carriage 121, the suction-control cylinders 119 are reversely energized so as to swing the levers 117 downwardly whereby the valve plates 114 are opened, thereby immediately disrupting the suction within the hoses 98. The raised rear edge of the top sheet $S_t$ thus tends to drop downwardly away from the seal ring 101 and hence drops onto and is supported by the forwardly projecting pins 137 associated with the pusher plates 136. The forward advance of the secondary carriage 121 continues so that the leading edge of the top sheet $S_t$ is cammed upwardly over the guide flange 72 and is thus fed into the nip between the pinch rollers 141 and 143. When reaching this position, the secondary carriage 121 is now at its forwardmost stroke position, whereupon the trolley 122 activates the reversing limit switch 133. At the same time, the nip rollers 141 and 143 drivingly engage the top sheet and movably advance it forwardly onto the conveyor belts 151, which continue to advance the top sheet until it is deposited on the top support table 18 of the slotter. The timing is appropriately synchronized with the motion of the slotter chain drive 22, and specifically the positioning of the drive slats 24 thereon, so that the deposit of the sheet from the belts 51 onto the table top 18 is such that the trailing edge of the sheet is positioned just ahead of the next lug 24 so that same then engages the sheet and advances same forwardly into and through the nip rolls 16 and slotter rolls 12-13. This forward advance of the sheet again causes activation of the limit switch 161 so as to initiate a further sheet-advancing cycle.

After the secondary carriage 121 reaches its forwardmost position and is reversed by the limit switch 133, then the pneumatic cylinders 127 are reversely energized so that the secondary carriage hence immediately moves rearwardly back to its initial position so as to await the next signal from the limit switch 161. Simultaneous with the initiation of the reverse movement of the secondary carriage 121, the valve-control cylinders 119 are energized upwardly and the bellows-control cylinders 102 are energized downwardly. These latter cylinders 102 cause the bellows 99 to flexibly extend downwardly so that the seal rings 101 engage the next uppermost sheet as indicated by dotted lines in FIG. 3. Prior to this engagement with the next sheet, valve 114 has already been closed so as to create an appropriate suction within hoses 98 and bellows 99. After an appropriate time delay, such as by a relay timer activated by the signal from the limit switch 133, the pneumatic cylinders 102 are reversely energized and hence retract the bellows 99 upwardly back to their original raised position whereby, due to the suction within the bellows, the rear edge portion of the next top sheet is lifted upwardly into the raised position indicated by solid lines in FIG. 3. This upward lifting of the rear portion of the top sheet is appropriately timed relative to the return movement of the secondary carriage so as to enable the secondary carriage to be substantially wholly retracted prior to completion of the raising movement of the sheet so that the sheet does not interfere with the sheet engaging elements 134. The device is now in position to initiate the next sheetadvancing cycle, which cycle will not be initiated until the appropriate signal is received from limit switch 161.

As the sheets are removed from the top of the stack 33, the elevator 32 remains stationary so long as the photocell 73 continues to indicate the presence of sheets, which photocell is positioned so as to permit approximately three or four sheets to be removed, following which the photocell then senses the absence of a sheet and hence emits an appropriate signal which energizes the drive device for the elevator 32, thereby causing the elevator platform 46 to be raised an incremental amount so that the sheet feeding operation can continue and several more sheets will be fed prior to further raising of the elevator. The provision of the extendible bellows 99, and its extension by the air cylinder 102, which is normally suitably controlled by means of a low-pressure air source, hence enables the lower pick-up position of the bellows to vary over a substantial range so that several pick-up cycles can be carried out without requiring any readjustment in the position of the sheet stack.

To initially supply a sheet stack 33 to the apparatus, and assuming the elevator platform 46 to be empty and in its lowered position, then the conveyors 34 and 67 are both energized, whereby a sheet stack 33 is movably advanced from the conveyor 67 and transferred automatically onto the conveyor 34 and moved forwardly until the sheet stack abuts the front guide plate 71. Conveyors 34 are then stopped, and the elevator platform 46 moved upwardly so as to engage and hence lift the sheet stack 33 upwardly until the uppermost sheets are within the selected range as determined by the photocell 73. The main carriage 37 is then moved forwardly until the positioning elements 88 are disposed adjacent the rear upper edge of the sheet stack, thereby adjusting the position of the carriage in correspondence with the width of the sheets being fed. The apparatus is now in position to initiate the cyclic feeding of sheets. During the first reciprocating cycle of the secondary carriage 121, no sheet is advanced inasmuch as the top sheet has not yet been lifted upwardly, so that on the retraction stroke of the secondary carriage, the suction bellows engages and lifts the rear edge of the top sheet upwardly into the position illustrated by FIG. 3. Thus, the next cyclic actuation of the apparatus results in feeding and advancing of the top sheet.

The control circuitry, both electrical and pneumatic, is conventional and can assume many different configurations as well understood by those familiar with such systems, so that a detailed description of same is believed unnecessary.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for picking up a single sheet of semi-rigid material from the top of a stack of such sheets and transporting the sheet in a forward direction away from the stack, comprising:

elevator means for supporting thereon the stack of sheets and for lifting same upwardly;

a pinch roller device having opposed counter-rotating rolls defining a nip therebetween for receiving and drivingly engaging a single sheet;

first horizontally-reciprocal carriage means positioned above said stack and having positioning means associated therewith positionable adjacent the upper rear edge of the stack;

suction-type pick-up means mounted on said first carriage means at a location positioned over the stack adjacent the rear edge of the top sheet for permitting engagement with the top sheet and lifting of the rear edge portion thereof, said pick-up means including a suction member vertically movable between an upper position for maintaining the rear edge portion of the sheet in a raised condition, and a lower position for permitting engagement with the rear edge portion of the top sheet;

said suction-type pick-up means including a suction source, a suction box defining therein a suction chamber, said suction box being mounted on said first carriage means and having opening means therethrough for providing communication between said suction chamber and the surrounding atmosphere, conduit means connected between said suction source and said suction box for creating a suction within said suction chamber, a valve member movably mounted on said suction box and movable for opening and closing said opening, a suction pick-up member positioned below said suction box and being in communication with said suction chamber, said suction member having a lower annular portion which defines an opening and which is adapted to be moved into engagement with the upper surface of the top sheet, and an activating device connected between said first carriage means and said suction pick-up member for vertically reciprocating the latter; and second carriage means movably supported on said first carriage means for back-and-forth movement in the widthwise direction of said stack, said second carriage means having sheet engaging means thereon disposed for supportingly engaging the raised rear edge portion of the top sheet and pushing said sheet forwardly so that the leading edge thereof is moved into engagement with the pinch roller device.

2. An apparatus according to claim 1, including a rotary slotter device positioned downstream of said pinch roller device, said slotter device including a substantially horizontal support surface for slidably supporting thereon the sheet, endless drive chain means having an upper reach extending substantially along said support surface, said upper reach having lug means associated therewith for drivingly engaging the rear edge of a sheet to advance same along the support surface, and sensor means associated with said slotter device for sensing the leading edge of the sheet to thereby activate said second carriage means to advance a further sheet to said pinch roller device.

3. An apparatus according to claim 1, wherein the suction pick-up member comprises an elongated tubular bellows which is extendible and contractible, said bellows having the upper end thereof connected to said suction box and the lower end thereof being adapted to be moved into engagement with the upper surface of the top sheet.

4. An apparatus according to claim 1, wherein said activating device maintains said suction pick-up member stationary in its raised position when the second carriage means is moved forwardly for pushing a sheet into engagement with the pinch roller device, and wherein said activating device undergoes a complete cycle and moves the suction pick-up member downwardly into engagement with the next top sheet and then lifts same upwardly into a raised position during the rearward movement of the second carriage means, and means for reversing the forward movement of the second carriage means at the forward position thereof and for energizing said activating device to initiate the downward movement of said suction pick-up member.

5. An apparatus according to claim 1, wherein said elevator means includes a vertically movable platform adapted to have a stack of said sheets supported thereon, drive means connected to said platform for vertically raising same, and sensor means for sensing the presence of the top sheet of the stack and for activating said drive means so as to maintain said top sheet within a selected vertical range.

6. An apparatus according to claim 5, wherein said elevator platform is of an open framework construction and defines therein a plurality of enlarged openings which project vertically through the platform, a plurality of endless conveyor belts positioned in side-by-side relationship directly beneath the elevator platform so that the endless conveyor belts are positioned within the openings of said platform when the platform is in its lowermost position, said conveyor belts having the upper surfaces thereof disposed slightly above the upper surface of the elevator platform so that a stack of sheets can be movably conveyed sidewardly by the conveyor belts onto the platform when the latter is in said lower position.

7. An apparatus according to claim 5, including a vertical alignment plate positioned directly adjacent the forward side of the elevator platform for permitting the front edge of the sheet stack to be effectively abutted thereagainst and slidably guided upwardly therealong, said alignment plate having an upwardly and outwardly inclined guide flange fixed to the upper edge thereof, said flange having the free edge thereof positioned directly adjacent the pinch roller device for slidably guiding the leading edge of the top sheet into the nip.

8. An apparatus for picking up a single sheet of semi-rigid material from the top of a stack of such sheets and transporting the sheet in a forward direction away from the stack, comprising:

elevator means for supporting thereon the stack of sheets and for lifting same upwardly;

a pinch device defining a nip for receiving and drivingly engaging a single sheet;

suction-type pick-up means positioned over the stack adjacent the rear edge of the top sheet for permitting engagement with the top sheet and lifting of the rear edge portion thereof, said pick-up means including a suction member vertically movable between an upper position for maintaining the rear edge portion of the sheet in a raised condition, and a lower position for permitting engagement with the rear edge portion of the top sheet;

said suction-type pick-up means including a suction source connected by a conduit means to a suction box which defines therein a suction chamber, opening means associated with the suction box for providing communication between the suction chamber and the surrounding atmosphere, a valve member movably mounted on said suction box and movable for opening and closing said opening, and a suction pick-up member in communication with said suction chamber, said suction pick-up member having a lower annular portion which defines an opening and which is adapted for engagement with the upper surface of the top sheet; and carriage means supported for back-and-forth movement in the widthwise direction of said stack, said carriage means having sheet-engaging means thereon disposed for supportingly engaging the raised rear edge portion of the top sheet and pushing said sheet forwardly so that the leading edge thereof is moved into engagement with the pinch device.

9. An apparatus according to claim 8, wherein the suction pick-up member comprises an elongated tubular bellows which is extendible and contractible, the lower end of the bellows being adapted to be moved into engagement with the upper surface of the top sheet, and a fluid pressure cylinder associated with the bellows and drivingly connected to the lower end thereof for vertically reciprocating same between said upper and lower positions.

10. An apparatus according to claim 8, including activating means connected to said suction pick-up member for vertically reciprocating the latter between said upper and lower positions, said activating means maintaining said suction pick-up member stationary in its upper position when the carriage means is moved forwardly for pushing the leading edge of the top sheet into the nip of the pinch device, and said activating means undergoing a complete cycle and moving the suction pick-up member downwardly into engagement with the next top sheet and then lifting same upwardly into its upper position during the rearward movement of the carriage means, and sensor means sensing the forwardmost position of the carriage means for reversing the movement thereof and for energizing said activating means to initiate the downward movement of said suction pick-up member.

11. An apparatus for picking up a single large sheet of semi-rigid material, such as a large sheet of corrugated or fiber paperboard, from the top of a vertical stack of such sheets and transporting the sheet in a forward direction away from the stack, comprising:

elevator means for supporting thereon the stack of sheets and for lifting same upwardly, said elevator means including a vertically movable elevator platform adapted to have a stack of said sheets supported thereon, and drive means for vertically raising said platform;

a vertical alignment plate positioned adjacent the forward edge of the elevator platform for permitting the front edge of the sheet stack to be effectively abutted thereagainst and slidably guided upwardly therealong;

a pinch device disposed adjacent the upper edge of said vertical alignment plate and defining a nip for receiving and drivingly engaging a single sheet;

an upwardly and outwardly inclined guide flange fixed to the upper edge of said vertical alignment plate, said guide flange having the free edge thereof positioned directly adjacent the pinch device for slidably guiding the leading edge of the top sheet into the nip;

sensor means disposed adjacent the upper edge of said vertical alignment plate for sensing the presence of the top sheet of the stack and for activating said drive means to cause lifting of the elevator platform so as to maintain said top sheet within a selected vertical range adjacent the upper edge of said alignment plate;

first horizontally-reciprocal carriage means having positioning means associated therewith and positionable adjacent the upper rear edge of the stack;

suction-type pick-up means mounted on said first carriage means at a location positioned over the stack adjacent the rear edge of the top sheet for permitting engagement with the top sheet and lifting of only the rear edge portion thereof so that the front edge portion of the top sheet remains in engagement with the next lowermost sheet of the stack, said pick-up means including a plurality of suction members disposed in a row which extends lengthwise of the top sheet adjacent the rear edge thereof, said suction members being vertically movable between an upper position for maintaining the rear edge portion of the sheet in a raised condition and a lower position for permitting engagement with the rear edge portion of the top sheet;

said pick-up means including activating means connected to said plurality of suction members for vertically raising and lowering same between said upper and lower positions;

second carriage means positioned above said stack and movably supported for back-and-forth movement in the widthwise direction of said sheet, said second carriage means having sheet engaging means thereon disposed for supportingly engaging the raised rear edge portion of the sheet and pushing said sheet forwardly so that the leading edge portion thereof is slidably displaced along said stack and upwardly along said guide flange so that the leading edge of the top sheet is moved into the nip of the pinch device; and means for disrupting the suction in said suction members to permit said suction members to disengage the rear edge portion of said sheet as said sheet engaging means moves into supporting engagement with said raised rear edge portion.

12. An apparatus according to claim 11, wherein each said suction member comprises an elongated tubular bellows which is extendible and contractible, said bellows having the upper end thereof mounted on said first carriage means and the lower end thereof being adapted to be moved vertically into engagement with the upper surface of the top sheet adjacent the rear edge thereof.

13. An apparatus according to claim 11, wherein said suction-type pick-up means includes an elongated suction conduit having one end thereof connected to said suction member and the other end thereof connected to a suction source, and said disrupting means including opening means in said conduit in the vicinity of its connection to said suction member, said opening means providing communication between the interior of said conduit and the surrounding atmosphere, and a movable valve member for opening and closing said opening means so as to permit the suction in said suction member to be disrupted when the valve member is moved into an open position.

* * * * *